US007733231B2

(12) United States Patent
Carney et al.

(10) Patent No.: US 7,733,231 B2
(45) Date of Patent: Jun. 8, 2010

(54) SECURITY DEVICE WITH DISPLAY

(75) Inventors: Mark D. Carney, Sterling, VA (US); Dorian A. Deane, Reston, VA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 495 days.

(21) Appl. No.: 11/694,035

(22) Filed: Mar. 30, 2007

(65) Prior Publication Data

US 2008/0238670 A1 Oct. 2, 2008

(51) Int. Cl.
*G08B 23/00* (2006.01)

(52) U.S. Cl. ..... 340/573.1; 235/382; 340/5.8; 340/691.6; 340/815.45; 380/270

(58) Field of Classification Search ..... 235/382, 235/382.5; 713/176, 182, 185, 186; 726/2, 726/26–28; 380/255, 258, 270; 340/573.1, 340/539.11, 572.1, 572.4, 10, 1, 5.2, 5.3, 340/5.8–5.83, 691.6, 815.45
See application file for complete search history.

(56) References Cited

U.S. PATENT DOCUMENTS

| | | | | |
|---|---|---|---|---|
| 5,960,085 | A * | 9/1999 | de la Huerga | 235/382 |
| 7,118,027 | B2 * | 10/2006 | Sussman | 235/375 |
| 7,165,718 | B2 * | 1/2007 | Blancas et al. | 235/380 |
| 2004/0026502 | A1 * | 2/2004 | Tame | 235/382 |
| 2004/0050930 | A1 * | 3/2004 | Rowe | 235/380 |
| 2004/0064453 | A1 * | 4/2004 | Ruiz et al. | 707/9 |
| 2005/0171787 | A1 * | 8/2005 | Zagami | 705/1 |
| 2005/0211767 | A1 * | 9/2005 | Sawachi | 235/380 |

* cited by examiner

*Primary Examiner*—Thomas J Mullen

(57) ABSTRACT

A security card may include a printed portion that includes printed data fixed to a first portion of an outer surface of the card, an interface configured to receive digitally signed information from an external device, and a display located on a second portion of the outer surface of the card and configured to display a digital image based on the received digitally signed information.

18 Claims, 14 Drawing Sheets

330

| 410 DATA | 420 TRUST LEVEL | 430 AUTHORITY | 440 SIGNATURE | 450 RESTRICTION | 460 DISPLAY |
|---|---|---|---|---|---|
| D1 | T1 | A1 | S1 | | 0 |
| D2 | T1 | A1 | S2 | | 1 |
| D3 | T3 | A7 | S11 | R1 | 0 |
| D4 | T4 | A2, A3 | S3, S4 | R2, R3 | 0 |

FIG. 4

370

510 520

| DAY/TIME | DEVICE ID |
|---|---|
| 3-14-07/1:26PM | D216 |
| 3-12-07/1:15PM | D216 |
| 2-24-07/1:17PM | D60 |
| 2-24-07/1:15PM | D60 |
| 1-25-07/3:29PM | D236 |
| 1-25-07/3:28PM | D236 |
| 1-25-07/3:27PM | D236 |
| 1-25-07/3:26PM | D236 |
| 1-25-07/3:25PM | D236 |
| 1-04-07/10:45PM | D216 |
| 1-04-07/10:44PM | D137 |
| 1-04-07/10:43PM | D216 |
| 1-04-07/10:41PM | D60 |
| 1-04-07/10:35PM | D60 |

FIG. 5

900
START

910
EXCHANGE ENCRYPTION INFORMATION
920
VALID?
NO
YES
930
ALLOW ACCESS TO DATA BASED ON LEVEL OF AUTHORIZATION
950
DENY ACCESS TO DATA
940
INDICATE VALID DISPLAY ON SECURITY DEVICE
960
INDICATE INVALID DISPLAY ON SECURITY DEVICE
END

SECURITY DEVICE WITH DISPLAY

BACKGROUND

At the present time, the need for positive identification of authorized personnel has become increasingly important. Existing methods of identifying people include the use of security badges that contain a photo of the authorized owner of the badge. Security badges are easily forged or altered by an attacker, for example, by replacing the photo of the original owner of the badge with a photo of the attacker. Therefore, a need exists for a more secure method of identifying authorized personnel.

BRIEF DESCRIPTION OF THE DRAWINGS

FIG. 4 illustrates a data structure according to an exemplary implementation;

FIG. 5 illustrates exemplary data stored in the log of FIG. 3;

DETAILED DESCRIPTION OF PREFERRED EMBODIMENTS

The following detailed description of the embodiments refers to the accompanying drawings. The same reference numbers in different drawings identify the same or similar elements. Also, the following detailed description does not limit the embodiments. Instead, the scope of the embodiments is defined by the appended claims and their equivalents.

Figure 1:
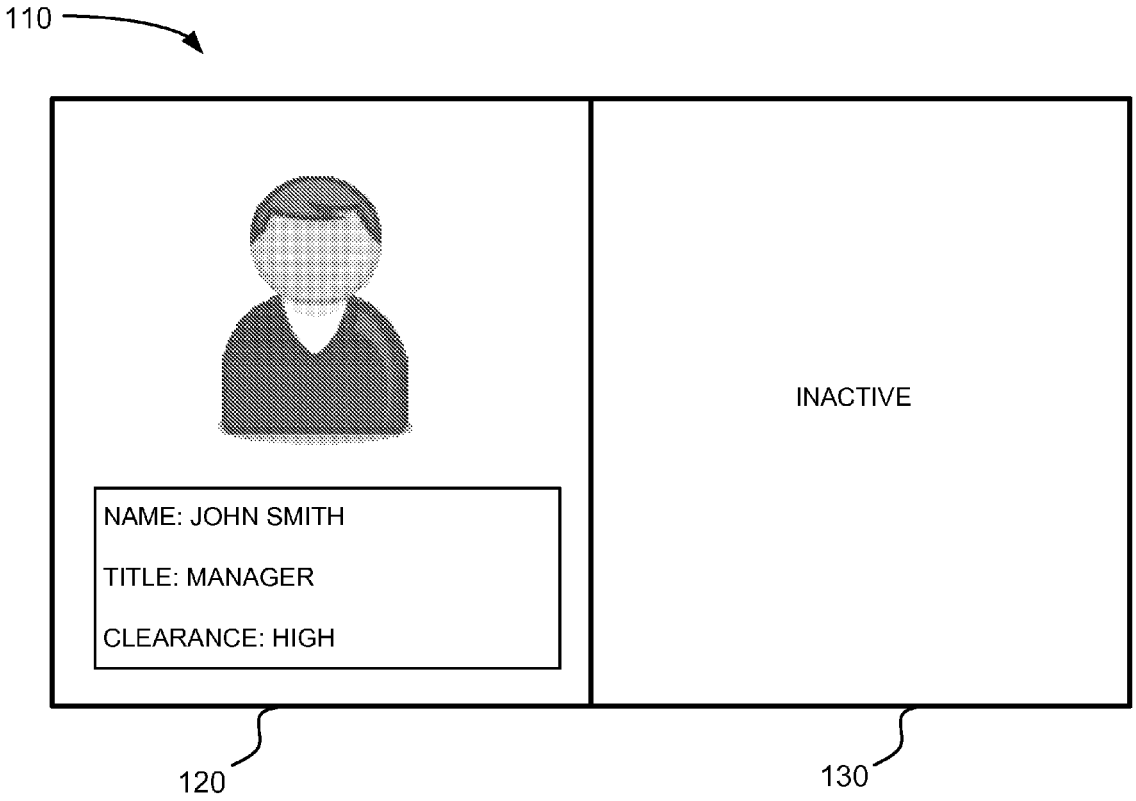
FIG. 1 illustrates a security device according to an exemplary embodiment.

FIG. 1 is a diagram of an exemplary security device 110. Security device 110 may include a printed portion 120 and a display portion 130. Security device 110 may be laminated, or use similar protective measures, in order to protect the surfaces of both the printed portion 120 and display portion 130 from, for example, the effects of light or other environmental factors. Security device 110 may be a portable or handheld device to be used, for example, as a security card or as an identification badge to enter or exit a secure building, etc. The surfaces of printed portion 120 and display portion 130 of security device 110 may be formed, for example, of a hard plastic or similar material. Security device 110 may also be constructed primarily of metal for use in high-impact environments and in such cases, printed portion 120 may be engraved or etched. In one embodiment, security device 110 may be approximately the size of a credit card, with dimensions such as 2 inches by 3½ inches, with a thickness of ¼ inch. In other embodiments for example, the size of security device 110 may be larger, such as 3 inches by 6 inches, with a thickness of ½ inch. The physical size and form of security device 110 is not limited to the examples described herein. Security device 110 may be embodied in various physical sizes and forms or in various devices such as, for example, universal serial bus (USB) fobs, smart cards, or other devices or forms of media. Security device 110 may, for example, also be used as a passport, a driver's license, or for disaster response identification purposes. Security device 110 may also be used concurrently for multiple purposes, such as those exemplified above.

Printed portion 120 may include a printed photograph of a person and printed information relating to the person's identification, occupation, security level, etc. For example, printed portion 120 may include text information such as "NAME: John Smith," "TITLE: Manager," "CLEARANCE: High" and a picture of John Smith. Additionally, printed portion 120 may include other markings, borders, holograms, etc., that may reduce the likelihood of producing forged or counterfeit security devices.

Display portion 130 may include a display device that may display information. Display portion 130 may include, for example, an electronic paper surface (e.g., e-paper or electronic ink), organic light emitting diodes (OLEDs), polymer LEDs (PLEDs), thin film transistor displays (TFTs), any type of liquid crystal displays (LCDs), or other display technologies. Display portion 130 may display information (text and/or images) based on data received from another security device or may display information based on data contained within security device 110. In this example, display portion 130 may display the default information "Inactive." As described below, display portion 130 may change the information displayed based on data exchanges with other security devices or security device readers, to, for example, provide indications of valid or invalid identification events.

Figure 2:
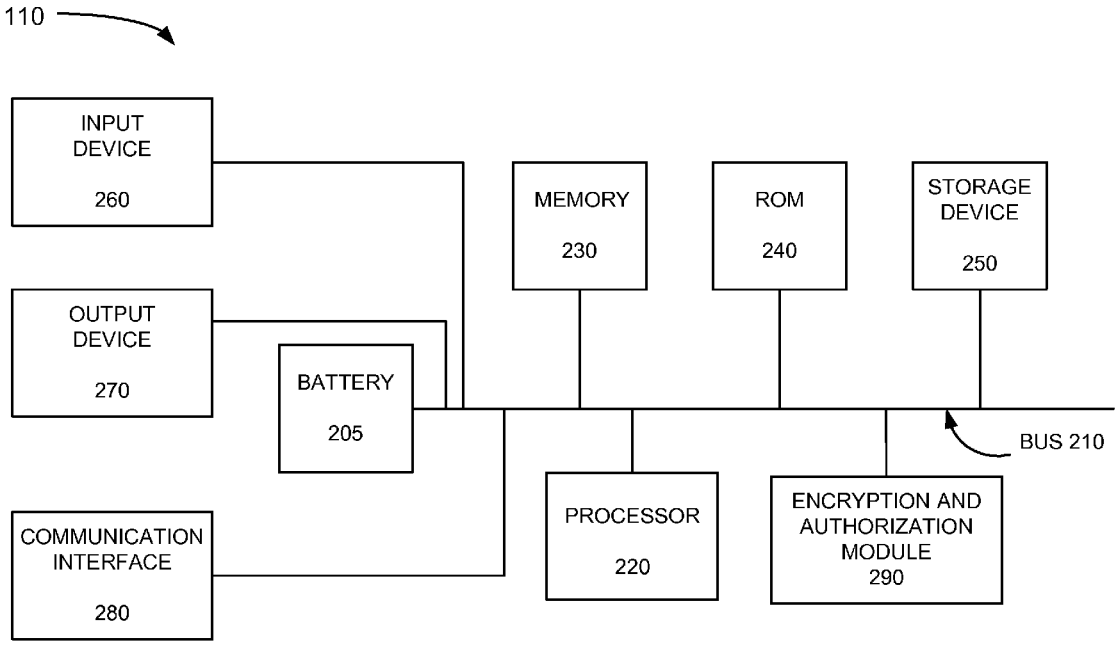
FIG. 2 is a block diagram of an exemplary security device.

FIG. 2 is a diagram of an exemplary configuration of a security device 110. Security device 110 may include an optional battery 205, a bus 210, a processor 220, a memory 230, a read only memory (ROM) 240, a storage device 250, an input device 260, an output device 270, a communication interface 280, and an encryption and authorization module 290. Security device 110 may be configured in a number of other ways and may include other or different elements than shown in FIG. 2.

Bus 210 permits communication among the components of security device 110. Optional battery 205 may include any type of battery used to supply power to security device 110. Battery 205 may be a rechargeable battery and/or may be recharged from power received from communication interface 280, for example. An optional additional battery may be used to allow continued operation while one power source is being replaced, for example.

Processor 220 may include any type of processor or microprocessor that interprets and executes instructions. Processor 220 may also include logic that is able to receive signals and/or information and generate data to control a display, etc. Memory 230 may include a random access memory (RAM) or another dynamic storage device that stores information and instructions for execution by processor 220. Memory 230 may also be used to store temporary variables or other intermediate information during execution of instructions by processor 220.

ROM 240 may include a conventional ROM device and/or another static storage device that stores static information and instructions for processor 220. Storage device 250 may include a magnetic disk or optical disk and its corresponding drive and/or some other type of magnetic or optical recording medium and its corresponding drive for storing information and instructions. Storage device 250 may also include a flash memory (e.g., an electrically erasable programmable read only memory (EEPROM)) device for storing information and instructions.

Input device 260 may include one or more mechanisms that may receive data into security device 110. For example, input device 260 may include a proximity chip capable of receiving data from another security device via one or more radio frequency (RF) receivers when another security device is in close proximity to security device 110, for example. Output device 270 may include one or more mechanisms that may output information from security device 110. For example, output device 270 may include a proximity chip capable of transmitting information to another security device via an RF transmitter, when another security device is in close proximity to security device 110, for example. Output device 270 may also include mechanisms to control display portion 130 to output and/or display information.

Communication interface 280 may include any mechanism that enables security device 110 to communicate with other devices and/or systems. For example, communication interface 280 may include a USB port, a modem or an Ethernet interface to a LAN. In addition, communication interface 280 may include other mechanisms for communicating via a network, such as a wireless network. For example, communication interface 280 may include one or more radio frequency (RF) transmitters and receivers and an antennas for transmitting and receiving (RF) signals. Communications interface 280 may also contain mechanisms for optical communications such as infrared receivers and transmitters. Communication interface 280 may also include mechanisms for receiving electrical signals used to recharge battery 205.

Encryption and authorization module 290 may include hardware and/or software that may process, protect and store data, images, encryption programs and authorization information. Data stored in encryption and authorization module 290 may be accessed or transmitted to another device based on authorization levels. For example, encryption and authorization module 290 may receive information identifying another security device, and may validate this received information before allowing further data transmissions between the security devices. Some data stored in the encryption and authorization module 290 may be protected such that it will never be disclosed (e.g., the private encryption key of the device).

According to an exemplary implementation, security device 110 may perform various processes in response to processor 220 executing sequences of instructions contained in memory 230 or ROM 240. Such instructions may be read into memory 230 from another computer-readable medium, such as storage device 250, or from a separate device via communication interface 280. A computer-readable medium may include one or more memory devices. Execution of the sequences of instructions contained in memory 230 or ROM 240 causes processor 220 to perform the acts that will be described hereafter. In alternative embodiments, hard-wired circuitry may be used in place of or in combination with software instructions to implement aspects of the present embodiments. Thus, the embodiments are not limited to any specific combination of hardware circuitry and software. For example, capabilities such as additional memory and/or processing power may be provided within security device 110 with the addition of other components.

Figure 3:
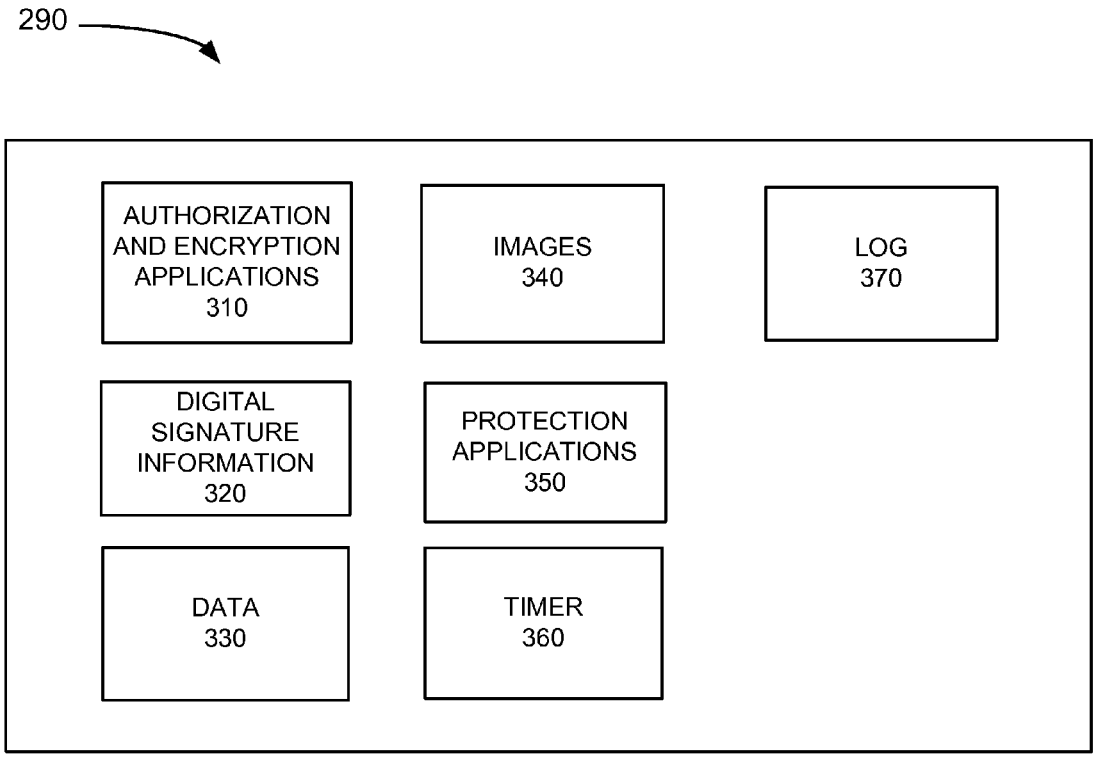
FIG. 3 is a diagram illustrating an exemplary encryption and authentication module contained in the security device of FIG. 2.

FIG. 3 is a functional block diagram illustrating exemplary components in encryption and authorization module 290. For example, encryption and authorization module 290 may contain authorization and encryption applications 310, digital signature information 320, data 330, images 340, a timer 350, protection applications 360, and a log 370.

Authorization and encryption applications 310 may include for example, a public encryption key, a private encryption key, and data relating to levels of authorization. All information and data stored in security device 110 may be accessed by another security device (or security device reader) based on the determined level of authorization of the reading device, as determined by authorization and encryption applications 310.

Digital signature information 320 may include information relating to the identification of security device 110 and information relating to an authority that may have validated the information stored in security device 110.

Data 330 may include encrypted and/or digitally signed information relating to the owner of security device 110, such as name, title/rank, occupation, level of clearance, date of birth, code words, PINs, pass phrases, images or biometric data, etc. Also stored and associated with data 330 may be information relating to a certified authority that provided the data. For example, clearance data may be associated with an authority such as the Department of Homeland Security or the Department of Defense.

Images 340 may include encrypted and/or digitally signed images such as photographs, fingerprints and/or retinal scans of the owner of security device 110. Images 340 may also include encrypted and/or digitally signed valid and invalid displays and pictures/images relating to security events and may also include animated images or a still image that may be displayed, for example, via display portion 130. Also stored and associated with images 340 may be information relating to a certified authority that provided the image and a digital signature that may be used to verify the image was issued by that authority. Images may have an associated timestamp/lifespan to allow the card to delete images that are no longer necessary as part of regular internal maintenance. For example, an encrypted and/or digitally signed image of an owner of security device 110 may be associated with the signing authority, such as the state of Virginia.

Protection applications 350 may include software and/or hardware that may protect data contained in encryption and authorization module 290. For example, protection applications 350 may destroy or erase data in encryption and authorization module 290 if an invalid security device attempts to access the stored data. Protection applications 350 may also detect multiple attempts to access data stored in encryption and authorization module 290, and may erase or destroy data based on a detected number of attempts to access data exceeding a predetermined threshold number or other events. The security device 110 may require that all data requests be made through the protection applications 350 to prevent unauthorized disclosure or alteration.

Timer 360 may include any type of timing mechanism that may track time. For example, timer 360 may include a crystal oscillator or any other type of time keeping mechanism. Timer 360 may also be used to validate or invalidate data 330 and/or images 340 based on elapsed or detected time as well as time-based algorithms. For example, data 330 may be invalidated after a 24 hour period.

Log 370 may store data that relates to past activities of security device 110. For example, log 370 may include information relating to day/time and identifications of other security devices that may have interacted with security device 110. Log 370 may also include data relating to days/times of passing into or out from security areas that may have read security device 110. In other embodiments the amount of data in log 370 may vary between implementations. For example, the log 370 may also include whether the reading device was recognized as a valid security device reader, whether authentication was successful, whether a display change occurred, etc.

FIG. 4 illustrates an exemplary data structure that may be stored in data 330. As shown, each item of stored data 410 may have a trust level 420, authority 430, signature 440, restrictions 450 and display flag 460 stored in association with it. In other embodiments, specifics of the data structure 330 may vary between implementations. For example, data 410 may also have associated fields indicating a time when the data was signed, when its signature will become invalid (limited lifetime), etc.

Data 410 may include information relating to an owner of security device 110. For example, data 410 may include an owner's name, title, level of trust, home address, social security number, etc. Data 410 may also include information relating to security events, procedures, etc. Data 410 may also include images (e.g., images 340 as described above with reference to FIG. 3) relating to an identity of the security device owner (e.g., the owner's image, fingerprints, voiceprints, other biometric data, etc.). Data 410 may also contain other forms of digital content deemed relevant by the security device 110 issuer.

Trust level 420 may include information identifying a level of trust that may be necessary to read and/or access corresponding data 410. For example, data 410 may be classified by four levels of trust indicated by T1, T2, T3 and T4 where trust level T1 is the most secure and highest level of trust. As further described below with reference to FIG. 9, data 410 may be accessed after comparing the trust level 420 of data 410 to the level of trust of another device. For example, a trust level 2 "T2" device may access any data 410 stored in security device 110 that may be associated with trust levels 2-4, but may not access trust level 1 "T1" data 410 in security device 110.

Authority 430 may include information identifying the authority that may have provided and/or may be associated with data 410. For example, authority "A1" may represent the Federal Bureau of Investigation (FBI) and authority "A7" may represent the Fairfax County Police Department.

Signature 440 may include a digital signature associated with the authority 430 that provided the associated data 410. For example, "S11" may represent the digital signature of corresponding authority "A7," the Fairfax County Police Department. In other examples, a single entry of data 410 may be "signed" (include the digital signature of) by a number of authorities, in which case there may be a number of authorities 430 and a corresponding number of signatures 440 associated with the single entry of data 410. For example, data "D4" may have been signed by authorities "A2" and "A3," therefore signatures "S3" and "S4" may be associated with data "D4."

Restriction 450 may include information relating to restrictions that may be associated with any item of data 410. For example, restriction "R1" may indicate that associated data "D3" may be accessed and read, however, it may not be changed. In other examples, as described above, if a single entry of data 410 (D4) is associated with a number of authorities 430, there may also be a corresponding number of restrictions 450 (R2 and R3), where a restriction 450 is based on the corresponding authority 430.

Display flag 460 may include information relating to whether the associated data 410 may be displayed by a device. For example, data "D2" may be accessed but not displayed. For example, display flag 460 may include a single bit value (e.g., one or zero), where a zero indicates that data 410 may be displayed and a one indicates that data 410 is not for display.

FIG. 5 illustrates an exemplary data structure contained in log 370. As shown in FIG. 5, each entry in log 370 may include day/time data 510 and an associated device ID 520. Log 370 may include other data entries (not shown). Day/time data 510 may include day and time information indicating the day and time a security device 110 interacted with another device. For example, when entering or leaving a restricted building, a device reader in the lobby of the building may interact with security device 110 to determine that security device 110 (and the owner) is valid and permitted to enter the building. The day and time of this interaction may then be stored in column 510. For example, information such as "03-14-07/1:26 PM" may be stored in column 510.

Device ID 520 may include an identifying number of another device which may have read data from or interacted with security device 110. As described above for example, a device reader in the lobby of a restricted building may be identified by an associated device ID number, such as D216. After interacting with device reader, the device ID "D216" may be stored in log 370, in column 520 associated with the information (03-14-07/1:26 PM) in day/time column 510.

In other embodiments, values in day/time data 510 and device ID in the entries of log 370 may be accessed by a security device reader and displayed. In further embodiments, display portion 130 of security device 110 may display information relating to data in log 370 and/or the amount of data stored in log 370, for example.

Figure 6:
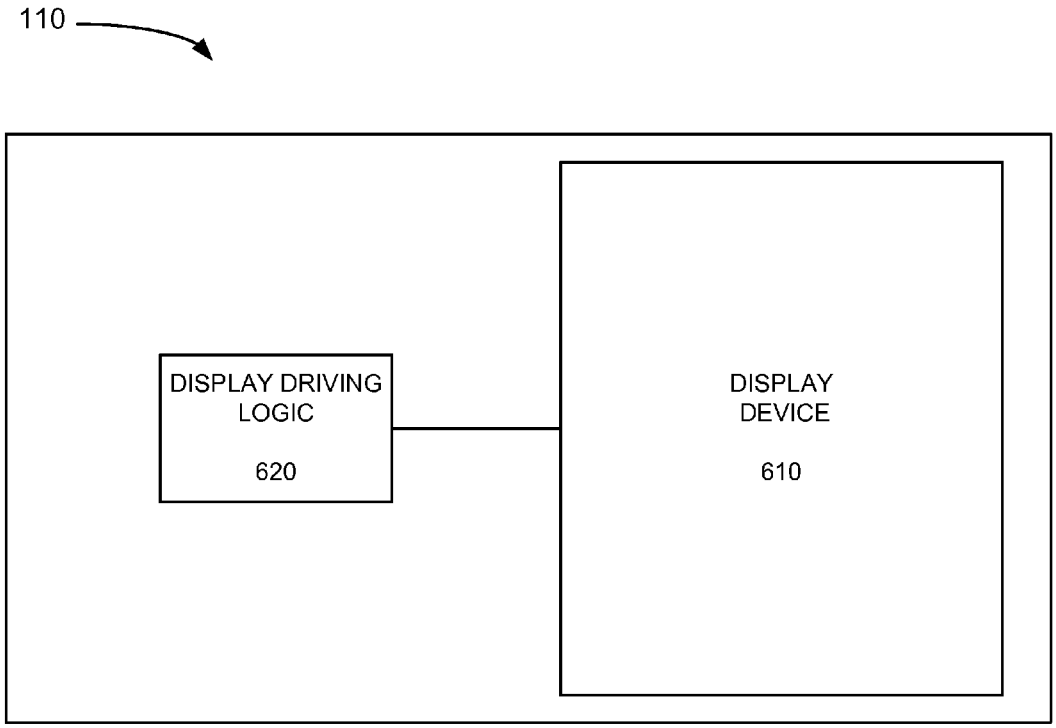
FIG. 6 is block diagram illustrating an exemplary display system of a security device.

FIG. 6 is a block diagram illustrating an exemplary display system of display portion 130 of security device 110. For example, the display system of display portion 130 may include a display device 610 and display driving logic 620.

Display device 610 may include any type of device capable of producing a display. For example, display device 610 may include an electronic paper surface (e.g., e-paper or electronic ink), organic light emitting diodes (OLEDs), thin film transistors (TFTs), liquid crystal displays (LCDs), etc. Display device 610 may include one or more display surfaces and each may be separately controlled by display driving logic 620.

Display driving logic 620 may include hardware and/or software for receiving signals and converting the received signals to control display device 610. For example, display driving logic 620 may receive a digital image from encryption and authorization module 290 and may control display device 610 to display this image.

Figure 7:
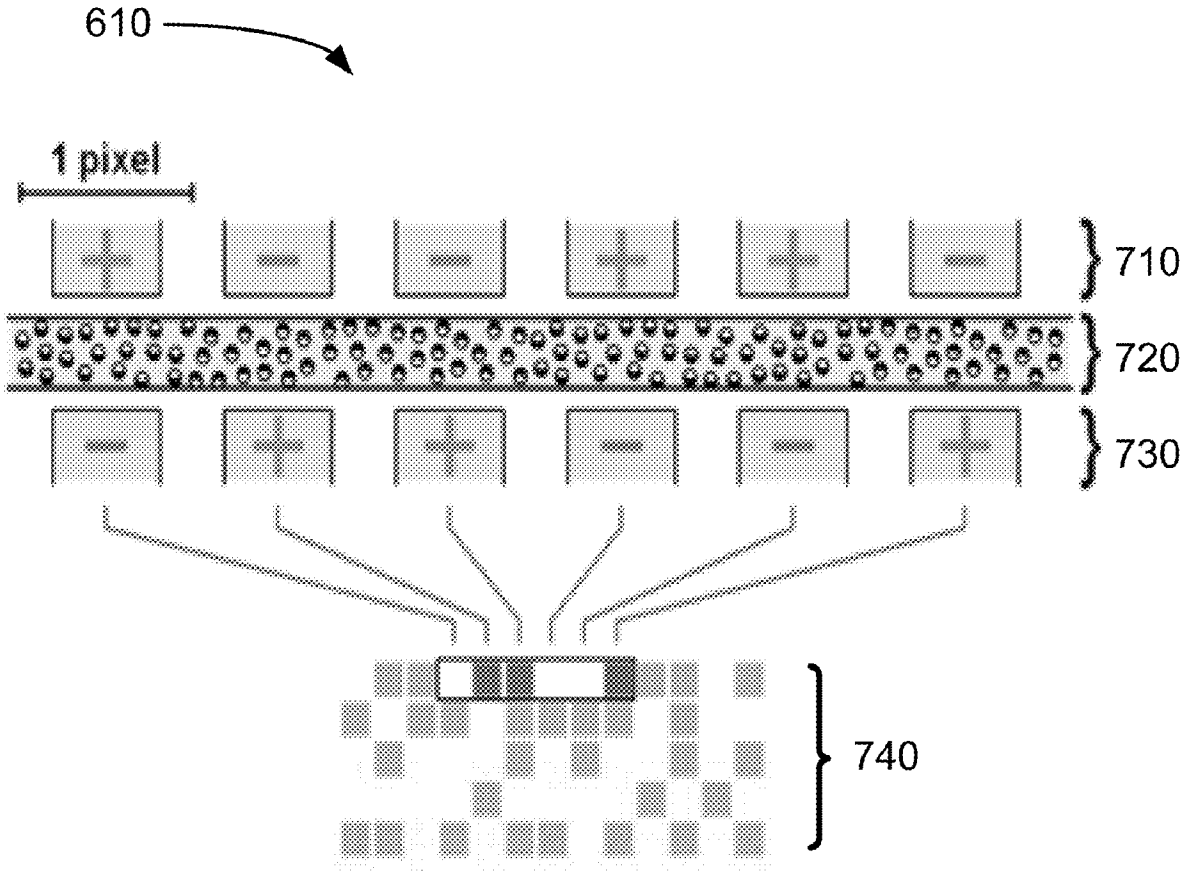
FIG. 7 is a diagram illustrating the display device of FIG. 6 according to an exemplary implementation.

FIG. 7 illustrates an exemplary implementation of display device 610 in which display device 610 includes an e-paper surface. As shown in FIG. 7, the e-paper surface may include a transparent electrode layer 710, a liquid polymer layer 720 and a lower electrode layer 730.

Transparent electrode layer 710 may include electrodes that are transparent so as to allow ink capsules in liquid polymer layer 720 to be visible. Transparent electrodes may receive signals from display driving logic 620.

Liquid polymer layer 720 may include ink capsules that contain black ink. The capsules may be charged dipoles that orient their position based on voltages applied to transparent electrode layer 710 and lower electrode layer 730. For example, when a negative voltage is applied to transparent electrode layer 710, ink capsules in liquid polymer layer 720 may orient the black side up towards the transparent electrode layer 710, thus giving the appearance of a black pixel on display surface 740. Similarly, when applying a positive voltage to transparent electrode layer 710, ink capsules in liquid polymer layer 720 may orient the white side up towards the transparent electrode layer 710, thus, giving the appearance of a white pixel on display surface 740.

Lower electrode layer 730 may include electrodes that receive voltage signals from display driving logic 620 to orient the electrically charged ink capsules in liquid polymer layer 720. In other embodiments of display surface 740, the transparent electrode layer 710 may not be included where ink capsules in liquid polymer layer 720 may be oriented by a single lower electrode layer 730, for example.

Figure 8:
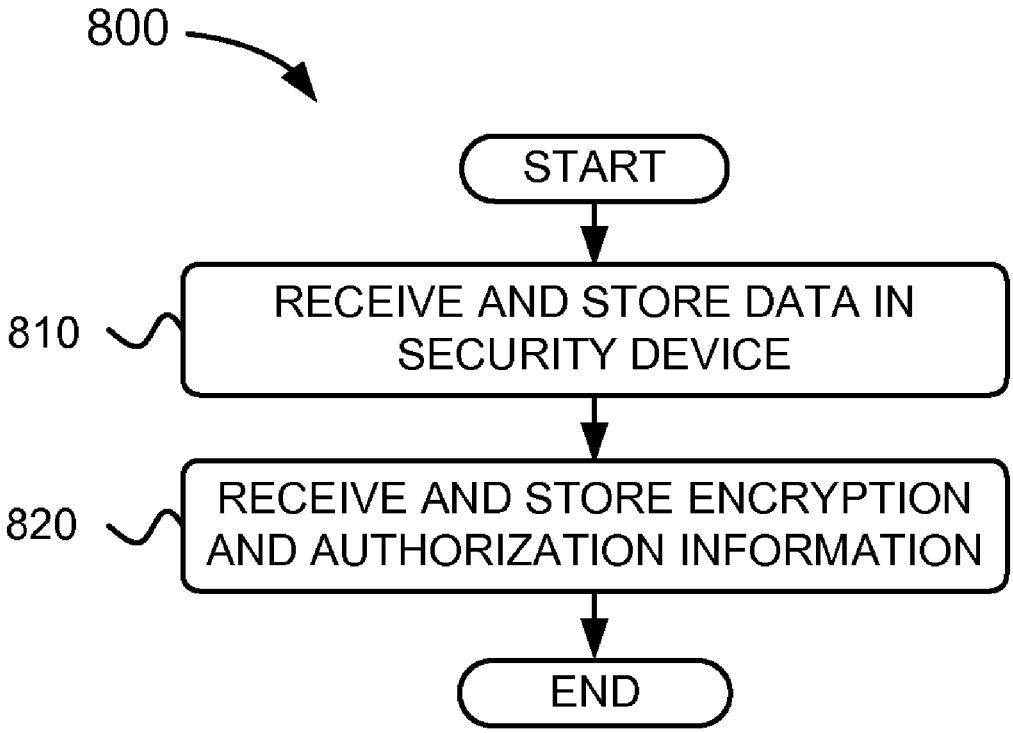
FIG. 8 is a flow diagram illustrating an exemplary process of storing data on a security device.

FIG. 8 illustrates an exemplary process 800 of storing data in security device 110. Process 800 may begin when security device 110 receives and stores data (block 810). For example, a trusted authority may collect data (text and/or images) relating to an individual and transmit this data to security device 110. The data may be received through communication interface 280, and stored in encryption and authorization module 290, for example. The received and stored text data may include name, title/rank, level of clearance, level of authorization, etc. The received and stored image data may include an image of the owner of the security device 110, fingerprint images, a full image of the security device 110, and other images related to the owner's level of authority or clearance, for example. The received text and image data may be respectively stored as data 330 and images 340, as shown in FIG. 3.

Referring to FIG. 4, for example, data items 410 that may be received and stored in security device 110 may also include other associated data (e.g., trust level 420, authority 430, signature 440, etc.). For example, the Department of Homeland Security may provide data "D1" that has an associated level of trust "T1." In this example, the data "D1" may also be associated with information "A1" identifying the authority (Department of Homeland Security) that has certified the content of the data "D1" and may also include digital signature information "S1" from the Department of Homeland Security, and information relating to any further restrictions to access or display the data "D1." In other examples, images may also be received and stored as shown in FIG. 4. For example, the state of Virginia may provide an image as data 410 used for a drivers' license which may also have associated items 420-460 that define a level of trust, the authority, the digital signature of the authority and restrictions as determined by the state of Virginia. In still further examples, data 410 stored in security device 110 may also include a unique identification number associated with the security device 110. For further details regarding the reception and storage of data, see co-pending U.S. patent application Ser. No. 11/694,037, entitled "SECURITY DEVICE READER" and filed on the same date herewith, the complete contents of which are herein incorporated by reference.

Process 800 may continue when security device 110 receives and stores encryption and authorization information (block 820). For example, a trusted authority may transmit a public encryption key, in some cases a related private encryption key and information relating to levels of authorization into security device 110. These received programs and information may be stored as authorization and encryption applications 310 in authorization and encryption module 290. After receiving and storing information as described above in blocks 810-820, security device 110 may interact with another device as described below with reference to FIG. 9.

Figure 9:
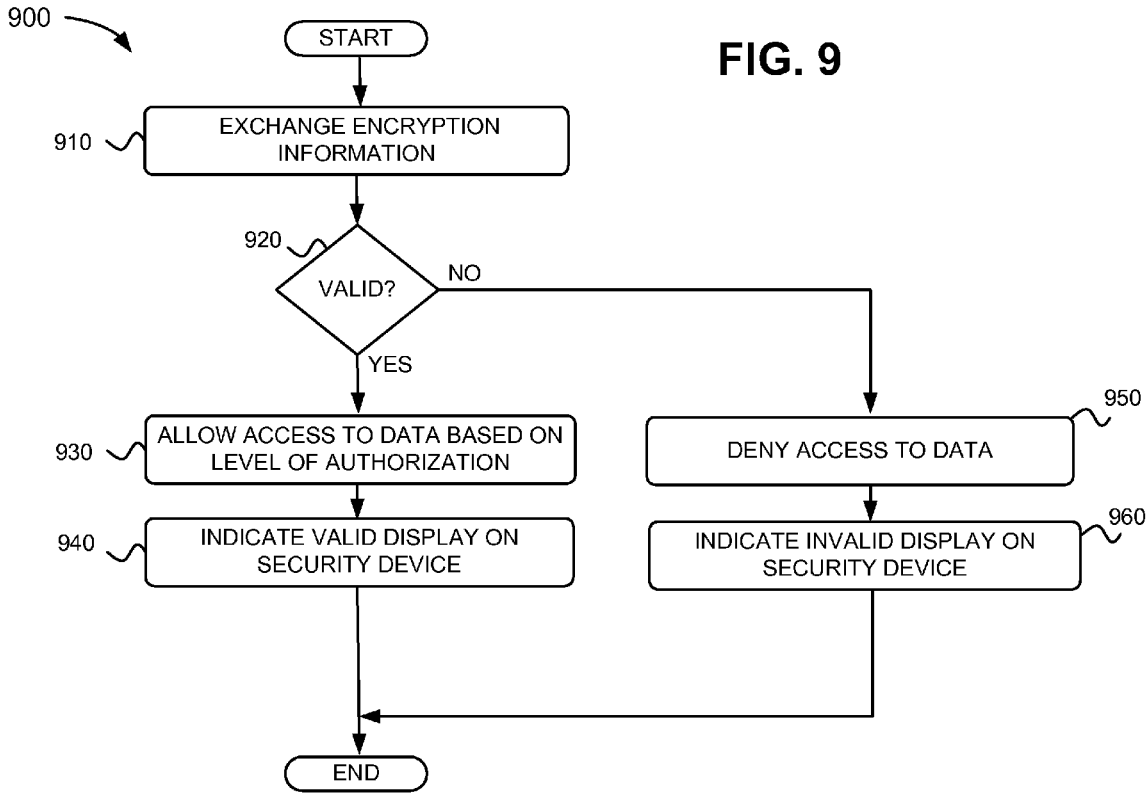
FIG. 9 is a flow diagram illustrating an exemplary process of reading data from a security device.

FIG. 9 is a flow diagram illustrating an exemplary process 900 of reading data from security device 110. Process 900 may begin with the exchange of encryption information with security device 110 (block 910). As used herein, the term encryption information may include encrypted information (such as data and/or images that may have been encrypted using any technique), digitally signed information (such as data and/or images which may or may not be encrypted), encryption keys, device identifier values and additional information relating to encryption or validation processes. For example, security device 110 may be passed through a security device reader, such as would be found entering or exiting a building. In this example, the security device reader may transmit identification information into security device 110 via input device 260. Based on this received identification information, security device 110 may transmit to, or allow security device reader to access stored information, via output device 270. For example, the security device reader may exchange encryption information with security device 110 (block 910) using methods such as public key infrastructure (PKI) technology. For example, a security device reader (or another security device) may use a private key to decrypt and validate digitally signed information exchanged and encrypted with a public key in security device 110, in order to confirm that security device 110 is valid and appropriately authorized before proceeding with further processing and exchanging of data. Each device may also verify that the other device's public key has a valid digital signature from a mutually trusted authority to prevent a man-in-the-middle attack.

In one example, when a security device 110 exchanges encryption information with another device using PKI techniques, security device 110 may transmit its public key (stored in encryption applications 310) to the reading device. The reading device may then verify the digital signature(s) on the public key of the security device 110 and use this received public key to encrypt a code or number along with the other device's own public key, which is then transmitted back to security device 110. Security device 110 may then decrypt this received encrypted information from the reading device using its stored private key. The decrypted code may then be encrypted by security device 110 using a public key received from the reading device and may then be sent back to the reading device. If the original code is successfully decrypted by the reading device and both devices determined the other's public key had a valid digital signature from a mutually trusted authority, a base level of trust has been established and an exchange of encryption information may continue. This exemplary process of exchanging encryption information may be employed in order to defeat man-in-the-middle attacks. Additionally, more encrypted data transmissions and verifications may be included the above example of exchanging encryption information. For example, digital signatures of the security devices may also be included in transmissions of public keys between interacting security devices 110 and the digital signatures on these public keys may be verified by each device upon reception, in order to ensure mutual authentication. Data 330 may be permanently bound to a specific security device 110 through cryptographic association with a specific device identifier such as a serial number factory-installed in ROM or other suitable device identifiers.

In other examples, fewer data transmissions and verifications may be performed when a security device 110 exchanges encryption information with another device using PKI techniques. For example, security device 110 may use its public key to encrypt a code or number and transmit the encrypted code or number to the reading device. Upon receiving the encrypted code or number, the security device reader (or another security device) may decrypt the code or number using a private key and determine that security device 110 is valid if the decrypted code is recognized, for example.

As described above, the exchange of encryption information may also be performed employing other types of encryption techniques. In other examples, security device 110 may request and verify an identification number of an interacting device before proceeding with an encryption exchange. In still further examples, the exchange of encryption information may include transmitting and receiving data and/or images that contain digital signatures (of the interacting devices) where the exchanged information is not encrypted. In further examples, the encryption exchange may include storing the identifying information relating to the device that has interacted with security device 110. For example, the day/time of interaction with another security device (or security device reader) and the interacting device ID may be stored in log 370, as shown in FIG. 5. Security device 110 may use any technique that may verify the presented content to an acceptable level of assurance and is not limited to the above example.

Processing may continue by determining if the exchange of encryption information was valid (block 920). For example, if two security devices 110, or a security device 110 and a security device reader, exchange encryption information and positively determine each others' identities and levels of authorization by accessing the encryption and authorization module 290 the exchange may be determined as valid (Yes). If the exchange does not succeed, the exchange may be determined to be invalid (No). For example, if an identification or digital signature of either device is not recognized by the other, or the exchange of an encrypted code or number does not result in a match of the originally encrypted code or number as described above, the encryption exchange may be determined to be invalid.

If the exchange of encryption information is valid, the security device or reader may be allowed to access data stored on security device 110 based on the authority 430 and trust level 420 (block 930). For example, using the level of trust stored in column 420 and the level of trust of the reading device, the appropriate data 410 may be transmitted to or read by the security device reader. For example, if trust level 1 is the highest level of trust, and a trust level 2 device such as a security device reader in a lobby or entryway, is reading data 410 from security device 110, data associated with levels 2-4 may be accessed by the reading device. A trust level 1 device, such as a security device reader located in the secured area of a restricted building, may access all data 410 stored in security device 110. In another example, if one security device is reading another security device, the interacting security devices 110 may access data that is within its level of authorization. For example, a manager's security device 110 may be a trust level 3 device that may read data 410 associated with trust levels 3-4, contained in an associates security device 110. The associate's security device 110 may be a trust level 4 device and may only access trust level 4 data within the manager's security device 110, such as the manager's image, name, title, etc.

Figure 10:
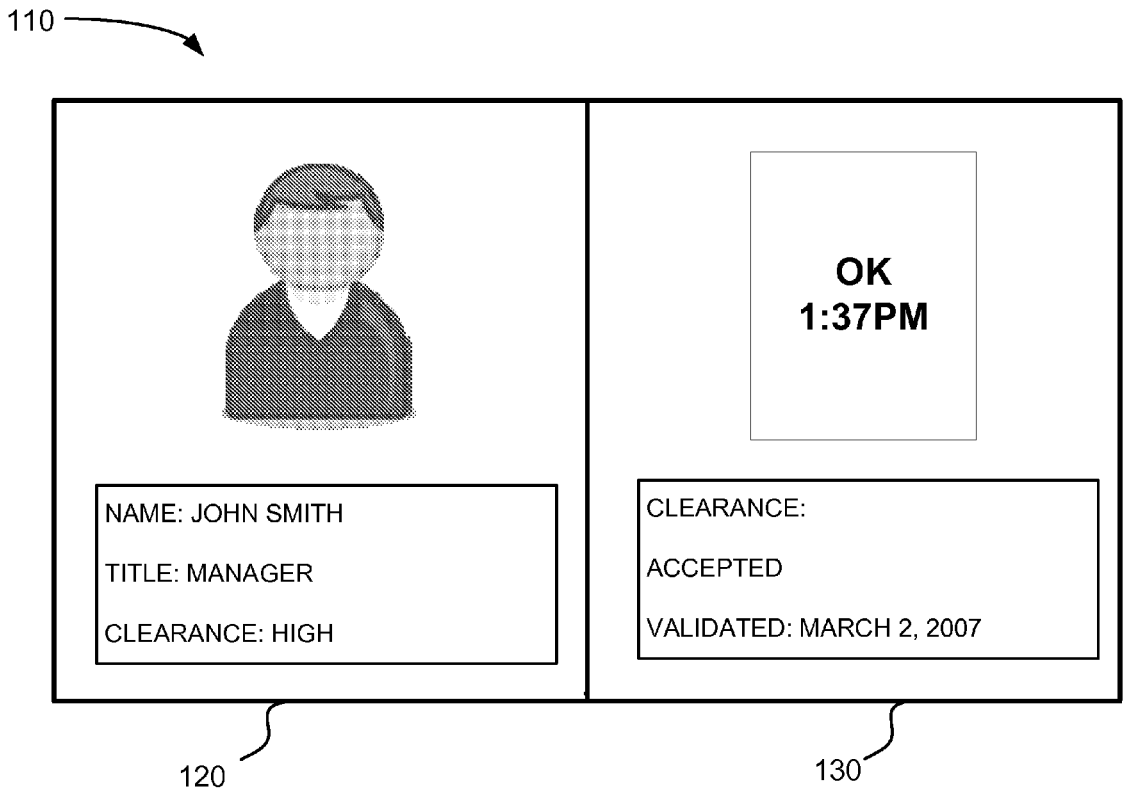
FIG. 10 illustrates an example of a security device that has been processed by the method described in FIG. 9.

After a valid encryption information exchange and access to data, display device 610 of security device 110 may be controlled to indicate that the security device 110 is valid (block 940). For example, FIG. 10 shows display portion 130 of a security device 110 that indicates a valid security device 110. For example, security device 110 may have previously displayed "Inactive" on display portion 130 and may have passed through a security device reader located at a building entrance. After successfully performing blocks 910-930, information such as "OK" and "1:37 PM" may be displayed on display portion 130 of security device 110. Additional text information such as "Clearance" "Accepted" and "Validated: Mar. 2, 2007" may also be displayed via display portion 130.

If an exchange of encrypted information is determined to be invalid, a security device 110 may deny access to stored data (block 950). For example, if a security device reader attempts to read a security device 110, where the security device reader contains an invalid identification, invalid/unrecognized digital signature, or lacks appropriate authority/trust combinations; security device 100 may not allow the reader to access its data. Additionally, protection applications 350, as shown in FIG. 3, may destroy or erase data within security device 100 in order to ensure that the data is not stolen, etc.

Figure 11:
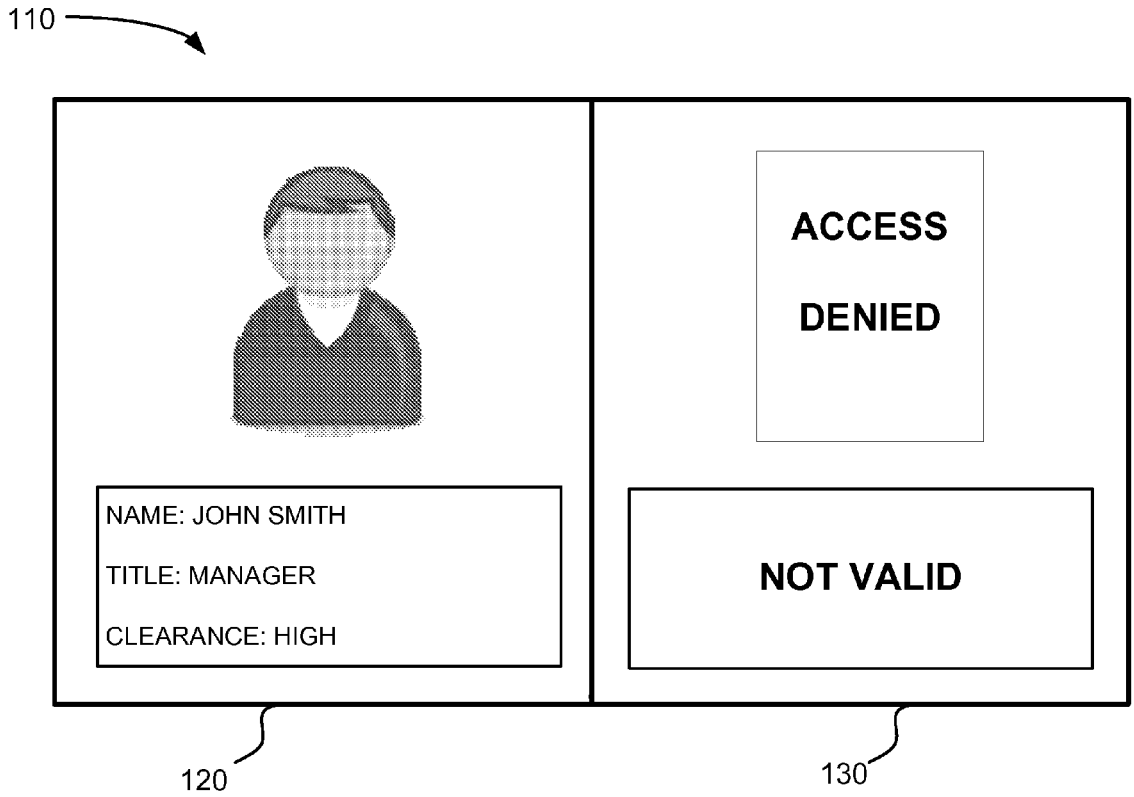
FIG. 11 illustrates another example of a security device that has been processed by the method described in FIG. 9.

If an exchange is determined to be invalid, display device 610 of security device 110 may be controlled to indicate an invalid security device 110 (block 960). For example, FIG. 11 shows an exemplary security device 110 that has been determined to be invalid. For example, security device 110 may have been passed through a security device reader at the entrance of building. If the security device reader determined an invalid identification or digital signature within security device 110, display portion 130 may be changed to display the test messages "ACCESS DENIED" and "NOT VALID." These displayed messages, images, etc., may also be produced after being read by another security device, for example.

In other embodiments, the exemplary display on security device 110 shown in FIG. 11, may be produced if the security device 110 may have been tampered with. For example, if numerous unsuccessful attempts to read data are detected by protection programs 350, "INVALID," may be displayed via display portion 130. Further, the stored data in security device 110 may be destroyed by protection applications 350 when tampering has been detected and/or a determined validation time period has expired, as determined by timer 360, for example.

Figure 12:
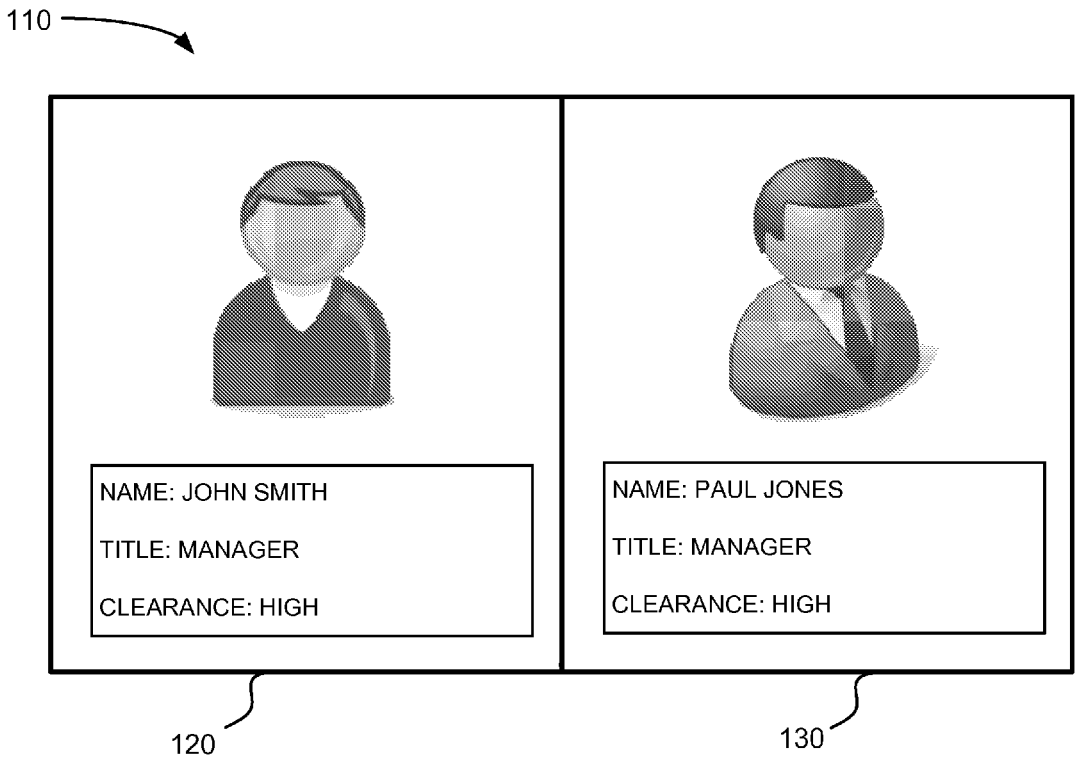
FIG. 12 illustrates another example of a security device that has been processed by the method described in FIG. 9.

FIG. 12 shows another example of indicating a valid display on a security device 110. In this example, security device 110 may have exchanged digitally signed and/or encrypted information with another security device, where the signed information received from the other security device is displayed via display portion 130. For example, the other security device may be owned by Paul Jones, where information such as Paul Jones' image, "Name: Paul Jones," "Title: Manager," and "Clearance: High," may be displayed via display portion 130. In this manner, the owner of security device 110 may quickly verify the identity of the correct owner of another security device along with the owner's authorization, as may be required, for example, for first responders at a restricted disaster area. The devices may transmit this information as a collection of signed digital objects or as a single signed image.

Figure 13:
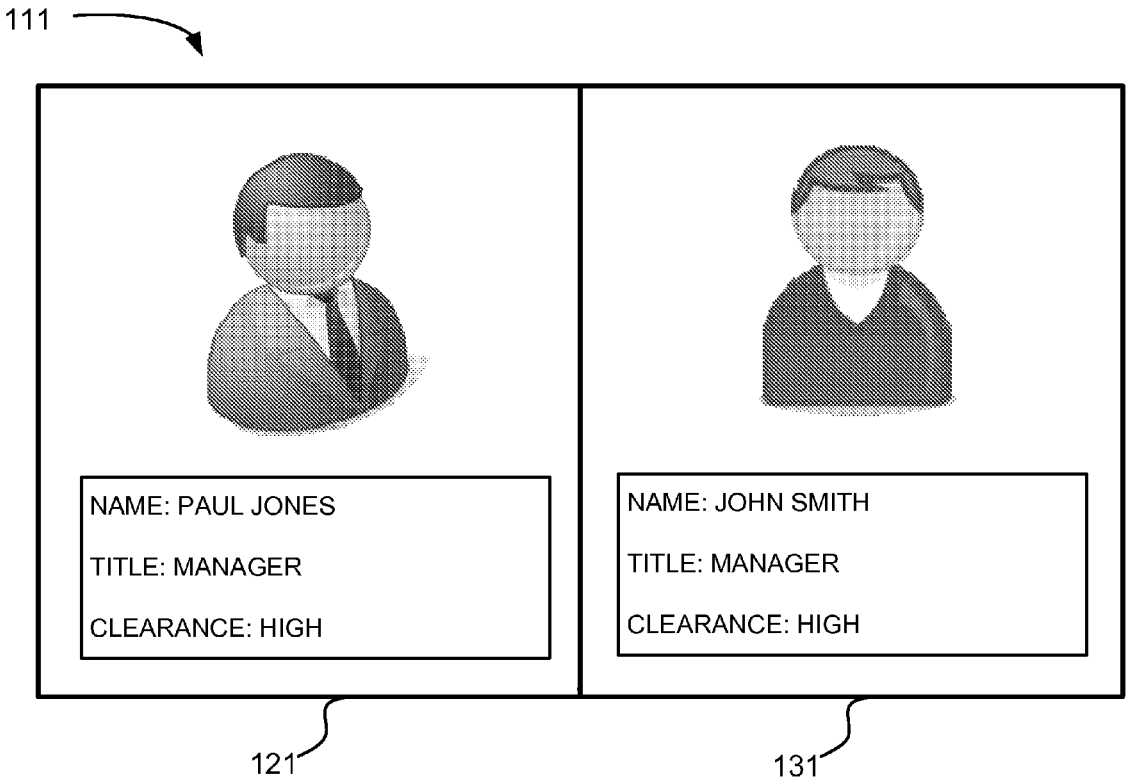
FIG. 13 illustrates another example of a security device that has been processed by the method described in FIG. 9.

FIG. 13 shows an exemplary security device 111 after being processed by the method of FIG. 9. As described above with respect to FIG. 12, security device 111 may be owned by "Paul Jones," and may include Paul Jones' image and information on printed portion 121. After exchanging encrypted information with John Smith's security device 110, Paul Jones' security device 111 may display John Smith's image and test data in display portion 131. In this example, test and images such as "Name: John Smith," "Title: Manager" and "Clearance: HIGH," may be received from security device 110 and may be displayed on security device 111. This may allow for an easy visual verification of the information being presented.

Figure 14:
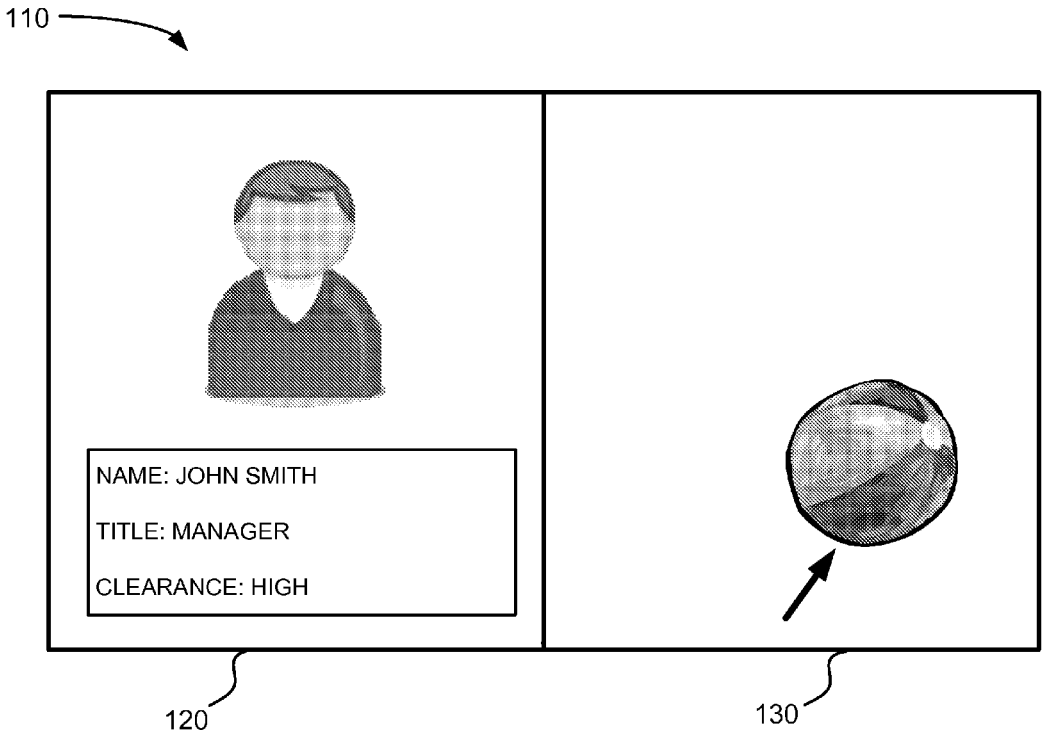
FIG. 14 illustrates another example of a security device that has been processed by the method described in FIG. 9.

FIG. 14 shows another example of displaying a valid security device 110. In this example, the display portion 130 of security device 110 may be controlled to display a sequence of animated images (e.g., a moving or bouncing beach ball). The sequence of animated images used to create this display may be received from another security device when entering a controlled area, for example. In other examples, scene specific images may be transmitted from one security device 110 to another. For example, an animation of a burning building may be transmitted between security devices at a fire emergency scene, and an image of a hurricane may be used for hurricane rescue workers, etc. In this manner, a security device 110 may be quickly identified as being valid by authorized personnel viewing the display portion 130. Displaying animated images on display portion 130 also makes forgeries difficult, as animated images may be determined or changed on a daily basis and may be easily distinguished from static, printed images. Security device 110 may also display text such as a time of authentication/authorization, descriptive name of the security device reader that approved the security device 110, etc. Either the text or the animation may be superimposed over the other.

Implementations described herein allow for quick identification and validation of the owners/identities of security devices 110. The foregoing description provides illustration and description, but is not intended to be exhaustive or to limit the embodiments to the precise form disclosed. Modifications and variations are possible in light of the above teachings or may be acquired from practice of the embodiments.

Further, while series of blocks have been described with respect to FIGS. 8 and 9, the order of the blocks may be varied in other implementations consistent with the embodiments. Moreover, non-dependent acts may be performed in parallel.

It will also be apparent to one of ordinary skill in the art that exemplary embodiments, as described above, may be implemented in other devices/systems, methods, and/or computer program products. Accordingly, the present embodiments may be embodied in hardware and/or in software (including firmware, resident software, micro-code, etc.). Furthermore, the present embodiments may take the form of a computer program product on a computer-usable or computer-readable storage medium having computer-usable or computer-readable program code embodied in the medium for use by or in connection with an instruction execution system. The actual software code or specialized control hardware used to implement aspects consistent with the principles of the embodiments is not limiting of the embodiments. Thus, the operation and behavior of the aspects were described without reference to the specific software code—it being understood that one of ordinary skill in the art would be able to design software and control hardware to implement the aspects based on the description herein.

Further, certain portions of the embodiments may be implemented as "logic" that performs one or more functions. This logic may include hardware, such as a processor, a microprocessor, an application specific integrated circuit or a field programmable gate array, software, or a combination of hardware and software.

No element, act, or instruction used in the description of the present application should be construed as critical or essential to the embodiments unless explicitly described as such. Also, as used herein, the articles "a" and "an" are intended to include one or more items. Where only one item is intended, the term "one" or similar language is used. Further, the phrase "based on," as used herein is intended to mean "based, at least in part, on" unless explicitly stated otherwise.

What is claimed is:

1. A card, comprising:
a printed portion that includes printed data fixed to a first portion of an outer surface of the card, wherein the printed portion further includes a user's name and image;
an interface configured to receive digitally signed information from an external device; and
a display located on a second portion of the outer surface of the card and configured to:
display a digital image based on the received digitally signed information.

2. The card of claim 1, wherein the interface is further configured to:
validate the received digitally signed information from an external device.

3. A card, comprising:
a printed portion that includes printed data fixed to a first portion of an outer surface of the card;
an interface configured to:
receive digitally signed information from an external device, and
validate the received digitally signed information from an external device; and
a display located on a second portion of the outer surface of the card and configured to:
display a digital image based on the received digitally signed information,
wherein the external device is a card reader and the digital image comprises one of text information or an image indicating a valid identification.

4. A card, comprising:
a printed portion that includes printed data fixed to a first portion of an outer surface of the card;
an interface configured to:
receive digitally signed information from an external device, and
validate the received digitally signed information from an external device; and
a display located on a second portion of the outer surface of the card and configured to:
display a digital image based on the received digitally signed information,
wherein the external device is a second card and the digital image comprises one of text information or an image indicating a valid identification.

5. A security device, comprising:
a printed portion comprising information fixed to an outer surface of the device, wherein the information comprises text and an image identifying a person;
a digital display unit configured to display a first image; and
logic configured to:
exchange encrypted information with an external device, and
control the digital display unit to display a second image based on the exchange, wherein the second image is different than the first image.

6. The device of claim 5, wherein the device comprises a card with the printed portion and digital display unit being located on the outer surface of the card.

7. The device of claim 5, wherein the digital display unit comprises one of an electronic paper surface, organic light emitting diodes, polymer light emitting diodes, thin film transistors, or liquid crystal display.

8. The device of claim 5, wherein the logic is further configured to:

control the digital display unit to display one of the second image or information relating to a user of the external device when the exchanged encrypted information is valid.

9. The device of claim 5, wherein the logic is further configured to:

control the digital display unit to display an animated sequence of images received from the external device when the exchanged encrypted information is valid.

10. A method, comprising:

receiving digitally signed information from a device at a security card, the security card having a surface that includes a printed portion and a digital display portion;

validating the received digitally signed information;

displaying other information on the digital display portion of the security card; and storing an identifier value and encryption keys at the security card.

11. The method of claim 10, wherein the received digitally signed information further includes:

the identifier value encrypted using an encryption key.

12. The method of claim 10, wherein the receiving digitally signed information from a device further includes:

receiving the digitally signed information from the device via one of wireless or wired transmissions.

13. The method of claim 10, wherein the digital display portion of the security card includes one of an e-paper surface or organic LEDs.

14. A method, comprising:

receiving digitally signed information from a device at a security card, the security card having a surface that includes a printed portion and a digital display portion;

validating the received digitally signed information;

displaying other information on the digital display portion of the security card; and storing digitally signed and encrypted data received from an authorized source, wherein an identity of the authorized source is associated with the stored digitally signed and encrypted data.

15. The method of claim 14, further comprising:

allowing access to the stored digitally signed and encrypted data based on validation and level of authorization of the device.

16. A method, comprising:

receiving digitally signed information from a device at a security card, the security card having a surface that includes a printed portion and a digital display portion;

validating the received digitally signed information;

displaying other information on the digital display portion of the security card;

detecting tampering of the security card; and destroying all stored data on the security card when tampering is detected.

17. A method, comprising:

receiving digitally signed information from a device at a security card, the security card having a surface that includes a printed portion and a digital display portion;

validating the received digitally signed information;

displaying other information on the digital display portion of the security card;

receiving one of an image or other identifying information of a user of the device; and displaying one of the image or the other identifying information of a user of the device on the digital display portion of the security card.

18. A method, comprising:

receiving digitally signed information from a device at a security card, the security card having a surface that includes a printed portion and a digital display portion;

validating the received digitally signed information;

displaying other information on the digital display portion of the security card;

receiving an animation sequence of images from the device; and displaying the animation sequence of images from the device on the digital display portion of the security card.

* * * * *